US006785489B2

(12) United States Patent
Anderson, II

(10) Patent No.: US 6,785,489 B2
(45) Date of Patent: Aug. 31, 2004

(54) GROUND PLATE FOR A PHOTOSENSITIVE DRUM ASSEMBLY

(75) Inventor: Earl Charles Anderson, II, Longmont, CO (US)

(73) Assignee: Pentax Technologies Corporation, Broomfield, CO (US)

( * ) Notice: Subject to any disclaimer, the term of this patent is extended or adjusted under 35 U.S.C. 154(b) by 0 days.

(21) Appl. No.: 10/119,776

(22) Filed: Apr. 11, 2002

(65) Prior Publication Data

US 2003/0194248 A1 Oct. 16, 2003

(51) Int. Cl.[7] ..... G03G 15/00
(52) U.S. Cl. ..... 399/90; 399/117
(58) Field of Search ..... 399/90, 116, 117, 399/159; 174/51

(56) References Cited

U.S. PATENT DOCUMENTS

| | | | | |
|---|---|---|---|---|
| 4,561,763 A | | 12/1985 | Basch | 399/116 |
| 4,839,690 A | | 6/1989 | Onoda et al. | 399/117 |
| 5,268,715 A | | 12/1993 | Hirano | 399/125 |
| 5,436,699 A | | 7/1995 | Komaki | 399/159 |
| 5,543,898 A | | 8/1996 | Shishido et al. | 399/111 |
| 5,729,792 A | | 3/1998 | Ikehara | 399/90 |
| 5,943,527 A | | 8/1999 | Kashiwagi et al. | 399/90 |
| 6,006,053 A | | 12/1999 | Ikehara | 399/90 |
| 6,185,390 B1 | * | 2/2001 | Higeta et al. | 399/90 |

FOREIGN PATENT DOCUMENTS

JP 2002-99177 * 4/2002

* cited by examiner

*Primary Examiner*—Hoan Tran
(74) *Attorney, Agent, or Firm*—Greenblum & Bernstein, P.L.C.

(57) ABSTRACT

A ground plate for a photosensitive drum assembly including a planar member having a central portion and a plurality of legs extending from the central portion. Each of the legs includes at least one projection extending therefrom. The projections are configured to scratch the inner surface of a photosensitive drum to make electrical contact between the ground plate and the photosensitive drum. The ground plate also includes a central aperture including spring contacts for engagement with a ground pin.

19 Claims, 7 Drawing Sheets

GROUND PLATE FOR A PHOTOSENSITIVE DRUM ASSEMBLY

BACKGROUND OF THE INVENTION

1. Field of the Invention

The present invention to relates to the field of ground plates, and more particularly to a ground plate for a photosensitive drum and improvements thereto.

2. Description of the Related Art

Photosensitive drums for use in image forming devices such as copying machines, facsimile machines, and printers are well known in the art. A typical photosensitive drum includes a hollow metal cylinder having an organic or non-organic photoconductive layer on the outer surface and a pair of end caps, as disclosed, for example, by U.S. Pat. No. 5,729,792 to IKEHARA et al., U.S. Pat. No. 6,006,053 to IKEHARA, and U.S. Pat. No. 5,943,527 to KASHIWAGI et al. The typical photosensitive drum assembly also includes a nonconductive flange inserted in each end of the photosensitive drum, a support axle passing through the drum via apertures in the flanges, and a ground plate attached to the inner surface of one or both of the flanges.

The prior art also includes a photosensitive drum cartridge, as disclosed, for example, by U.S. Pat. No. 4,839,690 to ONODA et al. This drum cartridge includes a hollow metal cylinder having a photosensitive layer, a pair of resin flanges inserted in the ends of the cylinder and a pair of positioning pins or drum shafts for supporting the drum cartridge, and a conductive plate attached to the inner surface of one of the flanges. A leaf spring portion of the conductive plate contacts the end face of one of the positioning pins.

A disadvantage of the prior art is the complicated nature of the ground plates. The prior art ground plates have particularly intricate and complicated shapes that are difficult to manufacture. Additionally, the manufacture of some of the prior art ground plates also includes several steps after cutting or stamping since the contact members for the ground pin must be folded back toward the center of the ground plate following the cutting or stamping of the ground plate.

Another disadvantage of the prior art is the disc shape of the prior art ground plates. The disc shaped ground plate consumes unnecessary material. Acceptable electrical contact to provide high quality grounding does not require that the entire end cap be covered. Therefore, it is not necessary to form the ground plate in a disc shape and waste valuable material. Another disadvantage of the disc shape of the prior art ground plate is that it is dangerous to handle. The disc shaped ground plate of the prior art includes projections about the entire circumference of the ground plate. The projections are very sharp in order to scratch the inner surface of the photosensitive drum. Therefore, sharp projections extend from the entire edge of the ground plate, and it is extremely difficult to quickly find a safe spot to grasp when handling the ground plate. Many handlers of such ground plates have been injured.

SUMMARY OF THE INVENTION

The present invention is directed to a ground plate for a photosensitive drum in an image forming device, which addresses the problems existing in the prior art, discussed above.

An aspect of the present invention provides a ground plate for a photosensitive drum assembly, including a substantially planar member, the substantially planar member including a central portion, and a plurality of legs extending from the central portion, at least one projection extending from each of the plurality of legs, each of the projections being configured to scratch an inner surface of a photosensitive drum in the photosensitive drum assembly to make electrical contact between the ground plate and the photosensitive drum. The legs may extend in directions substantially parallel to each other. Further, each of the projections may extend in directions substantially parallel to each other.

According to a further aspect of the present invention, the plurality of legs may include four legs, and the central portion and the four legs may substantially form an H shape. Further, each of the legs may include two projections extending therefrom to scratch the inner surface of the photosensitive drum, and the projections may extend out of the plane of the substantially planar member.

In a further aspect of the present invention, the substantially planar member may include a two piece construction. The substantially planar member may further include a first leg and a second leg, each of the first leg and the second leg including a spring contact extending from a central portion thereof, the first and second legs being spaced from each other to secure a ground pin therebetween when fixed to an end cap. The ground plate may farther include a central aperture in the central portion, and a plurality of spring contacts extending into the central aperture, wherein the central aperture receives a ground pin therethrough and the plurality of spring contacts engage the ground pin to make electrical contact between the ground plate and the ground pin. Further, the ground plate may include two spring contacts. The ground plate may further include a plurality of apertures provided in the substantially planar member, each of the apertures being configured to receive a protrusion on an end cap of the photosensitive drum assembly, and a plurality of projections provided in each of the apertures, the projections being configured to engage the protrusions on the end cap of the photosensitive drum received in the apertures and to fix the ground plate to the end cap of the photosensitive drum.

A further aspect of the present invention provides a photosensitive drum assembly for an image forming device including a photosensitive drum, the drum including a photosensitive layer on an outer surface thereof, a first end cap and a second end cap, the end caps being configured to fit into the ends of the drum, and a ground plate fixed to an inner face of the first end cap, the ground plate including a substantially planar member, the substantially planar member including a central portion, and a plurality of legs extending from the central portion, at least one projection extending from each of the plurality of legs, each of the projections being configured to scratch an inner surface of the photosensitive drum to make electrical contact between the ground plate and the photosensitive drum. The photosensitive drum assembly may further include a ground pin extending through an aperture in the first end cap, and the ground plate further including a central aperture in the central portion, and a plurality of spring contacts extending into the central aperture, wherein the central aperture receives the ground pin therethrough and the plurality of spring contacts engage the ground pin to make electrical contact between the ground plate and the ground pin.

Another aspect of the present invention provides an image forming device including a printer engine, and a photosensitive drum assembly mounted in the printer engine, the photosensitive drum assembly including a photosensitive drum including a photosensitive layer on an outer surface thereof, a first end cap and a second end cap, the end caps being configured to fit into the ends of the drum, and a ground plate fixed to, an inner face of the first end cap, the ground plate including a substantially planar member, the substantially planar member including a central portion, and a plurality of legs extending from the central portion, at least one projection extending from each of the plurality of legs, each of the projections being configured to scratch an inner surface of the photosensitive drum to make electrical contact between the ground plate and the photosensitive drum. The image forming device may further include an engine frame, a spring ground contact mounted on the engine frame, the photosensitive drum assembly further including a ground pin extending through an aperture in the first end cap, the ground plate further including a central aperture in the central portion, and a plurality of spring contacts extending into the central aperture, wherein the central aperture receives the ground pin therethrough and the plurality of spring contacts engage the ground pin to make electrical contact between the ground plate and the ground pin, and wherein the ground pin is configured to contact the spring ground contact to make electrical contact between the ground pin and the spring ground contact to ground the photosensitive drum.

BRIEF DESCRIPTION OF THE DRAWINGS

The above and other objects, features and advantages of the present invention will be made apparent from the following description of the preferred embodiments, given as nonlimiting examples, with reference to the accompanying drawings in which.

DETAILED DESCRIPTION OF THE INVENTION

Figure 1:
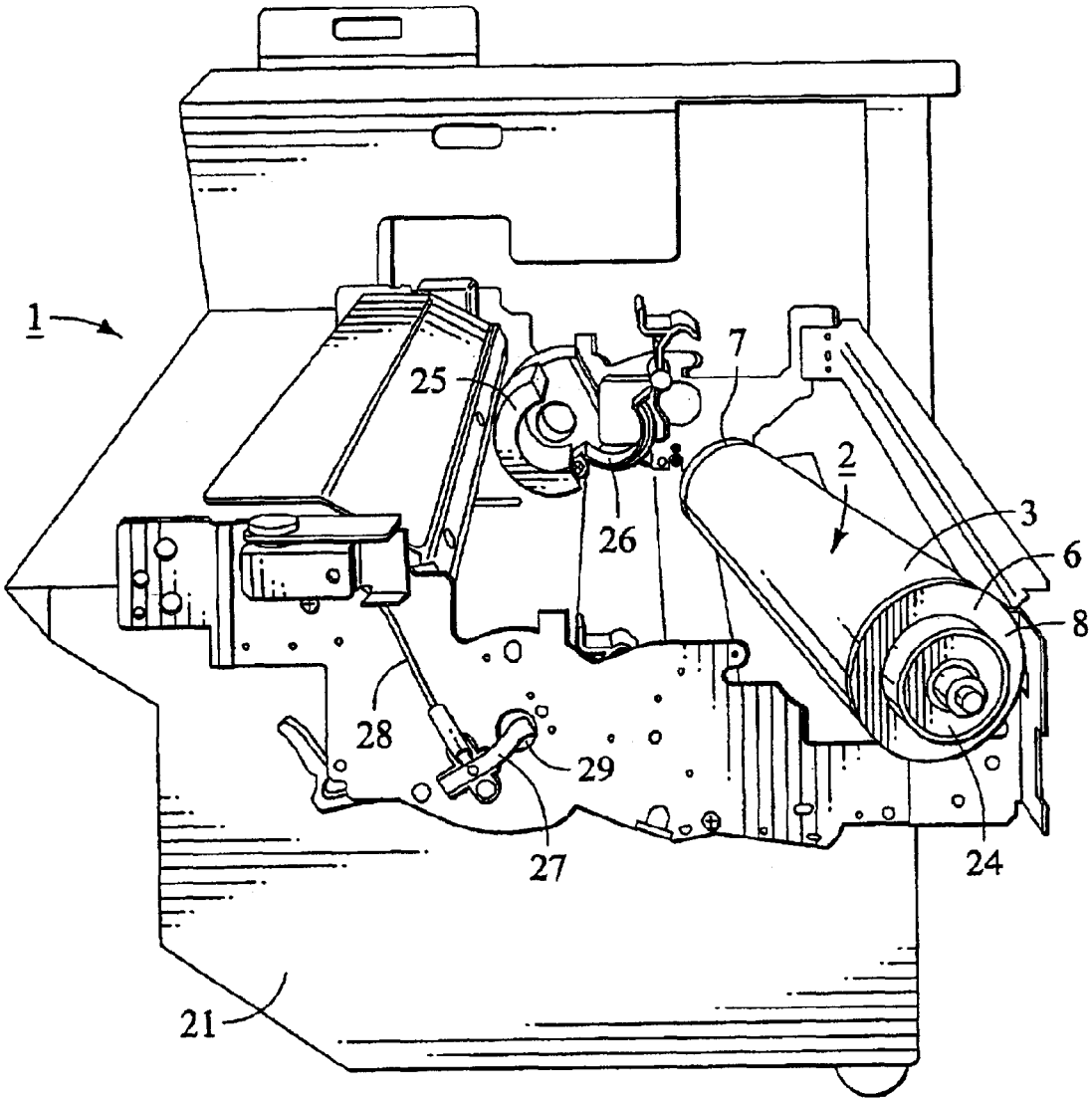
FIG. 1 is an exploded side view of a printer including an organic photoconductor (OPC) drum and which may include the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

With reference to FIGS. 1–6 of the drawings, reference numeral 1 denotes an image forming apparatus such as, for example, a printer, copying machine, or facsimile machine of the present invention. The image forming apparatus includes a photosensitive drum assembly 2 on which is formed an electrostatic latent image. A developing device provides oppositely charged toner to adhere to the photosensitive drum and form an image. This image is then transferred to a substrate, such as paper.

The photosensitive drum assembly 2 includes a photosensitive drum 3. The photosensitive drum 3 may be any type known to those of skill in the art, and in the present invention, includes an organic photoconductor (OPC) drum. The photosensitive drum 3 is a hollow cylinder constructed of an electrically conductive material such as, for example, aluminum. The photosensitive drum 3 is coated on the outer surface with a layer of photoconductive material 4 and includes an anodized inner surface. The photosensitive drum assembly 2 includes a front end cap 6 and a rear end cap 7. The front end cap 6 and rear end cap 7 are constructed of an insulative material such as for example, plastic or resin. The front end cap 6 and rear end cap 7 each have an appropriate diameter so as to engage in a press fit with the ends of the photosensitive drum 3.

Figure 2:
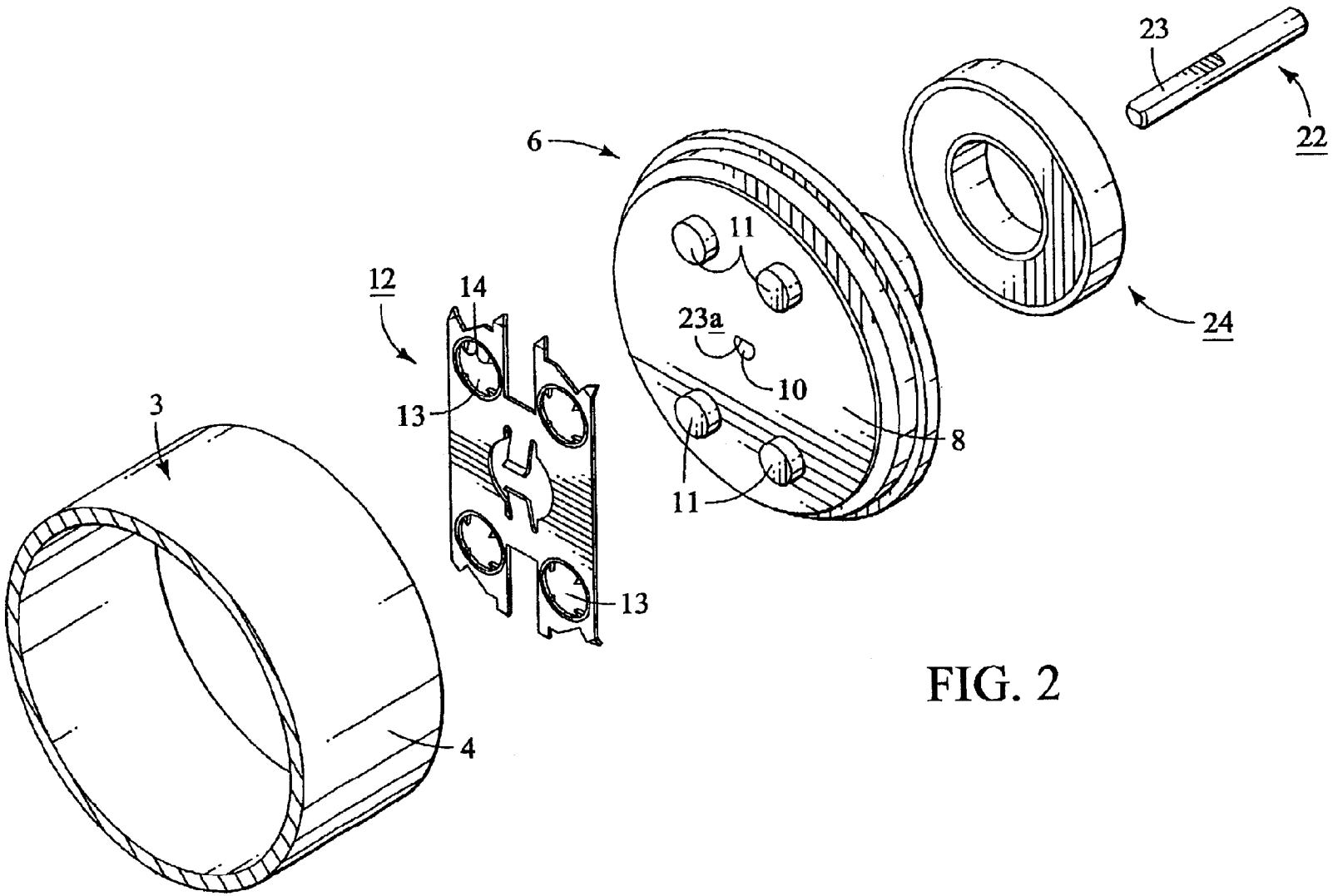
FIG. 2 is an exploded perspective view of an OPC drum and which may include the present invention.
Figure 3:
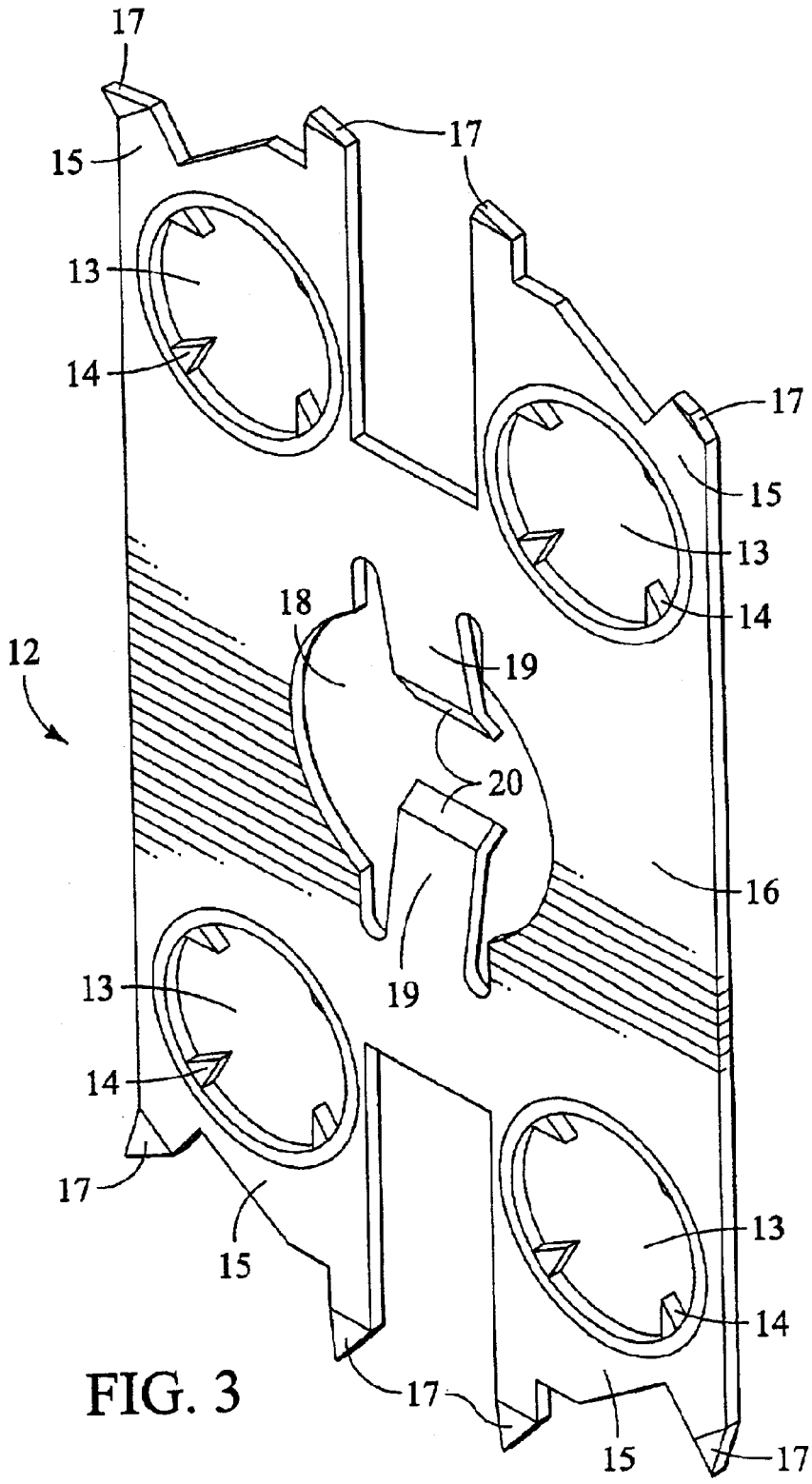
FIG. 3 is a front view of a ground plate according to a first embodiment of the present invention.
Figure 4:
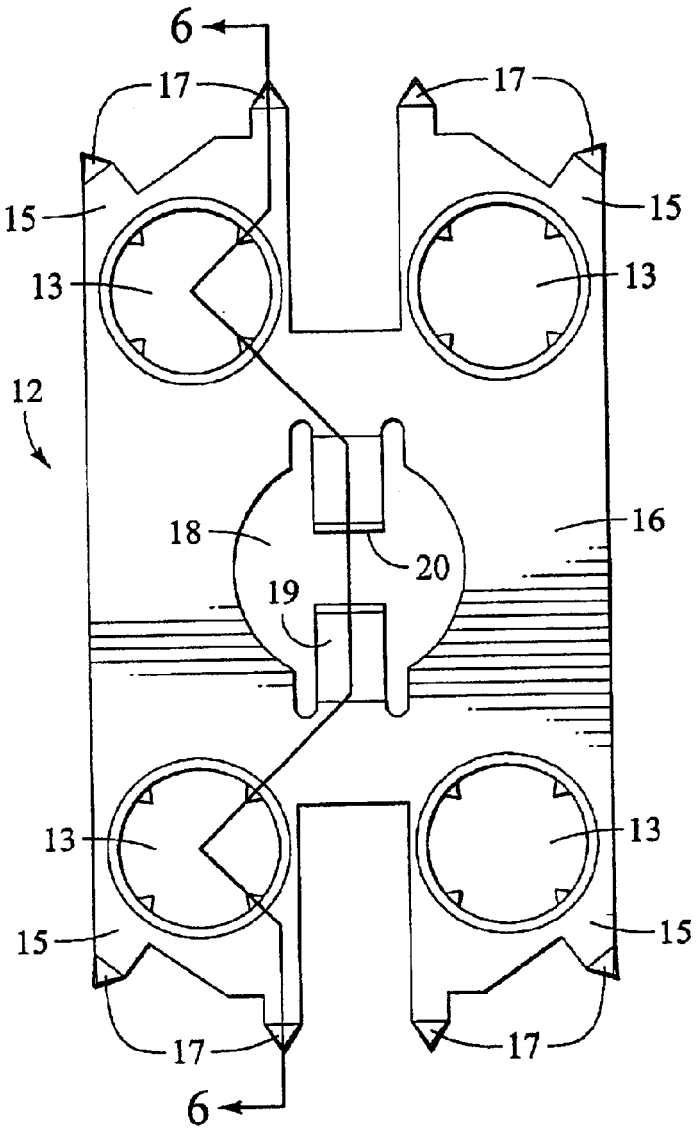
FIG. 4 is a perspective view of the ground plate of FIG. 3.
Figure 5:
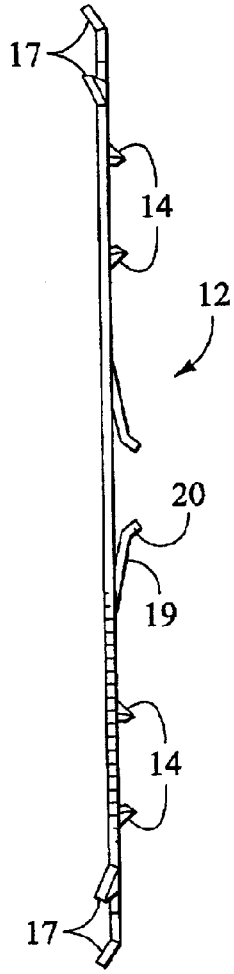
FIG. 5 is a side view of the ground plate of FIG. 3.

As shown in FIG. 2, the front end cap 6 includes an inner face 8, an outer face, a center aperture 10, and a plurality of protrusions 11 extending from the inner face 8. The front end cap 6 may include any suitable number of protrusions 11, and in the present embodiment includes four protrusions 11. The photosensitive drum assembly 2 further includes a ground plate 12. The ground plate 12 is substantially planar and is constructed of any suitable electrically conductive material such as, for example, metal, including spring steel, and may be formed by any suitable process such as, for example, stamping. The ground plate 12 includes a plurality of apertures 13, preferably corresponding in number to the number of protrusions 11 extending from the inner face 8 of the front end cap 6. Each of the apertures 13 in the ground plate 12 include a plurality of projections or tabs 14 extending toward the center of the aperture 13. Each aperture 13 may include any suitable number of tabs 14, and in the present embodiment, includes four tabs 14. The circumference of each of the apertures 13 is larger than the circumference of each of the protrusions 11. The front end cap 6 and the ground plate 12 are assembled by inserting the protrusions 11 extending from the inner face 8 of the front end cap 6 into the apertures 13 in the ground plate 12. The tabs 14 extend into the apertures 13 a sufficient distance such that the ground plate 12 is frictionally fixed to the inner face 8 of the front end cap 6 by engagement between the tabs 14 and the edges of the protrusions 11. The tabs 14 are pliable and may be bent or folded due to the assembly of the ground plate 12 and the front end cap 6. Alternatively, the tabs 14 may be pre-bent so as to aid in the assembly.

The ground plate 12 has substantially an H shape including four legs 15 connected by central portion or cross member 16. Each of the legs 15 includes a plurality of pointed projections 17 extending therefrom. Each leg 15 may include any suitable number of projections 17, and in the present embodiment includes two projections 17. The projections 17 may extend from the plane of the ground plate 12, or alternatively, the projections 17 may be pre-bent. The ground plate 12 further includes a central aperture 18. Extending into the aperture 18 are a plurality of arms or spring contacts 19. The ground plate may include any suitable number of spring contacts 19, and in the present embodiment includes two spring contacts 19. Each spring contact 19 may be pre-bent from the plane of the ground plate 12, and each spring contact 19 may include a pre-bent end portion 20.

The assembly of the front end cap 6 with the ground plate 6 frictionally affixed thereto is inserted into an end of the photosensitive drum 3. The front end cap 6 has an appropriate circumference so as to engage in a frictional fit with the inner surface of the photosensitive drum 3. The projections 17, either planar or pre-bent, extend from the ground plate 12 a sufficient distance so that when the ground plate and front end cap assembly is inserted into the photosensitive drum 3, the projections 17 contact the inner surface of the photosensitive drum 3. The projections 17 scrape or scratch the anodized inner surface of the photosensitive drum 3, making electrical contact between the ground plate 12 and the photosensitive drum 3. By scratching through the anodized surface of the photosensitive drum 3, the ground plate 12 provides improved electrical contact with the aluminum core of the photosensitive drum 3 which is necessary for proper printer operation. This contact must then be carried to the printer engine frame such that the photosensitive drum 3 is electrically grounded to the engine frame 21.

Figure 6:
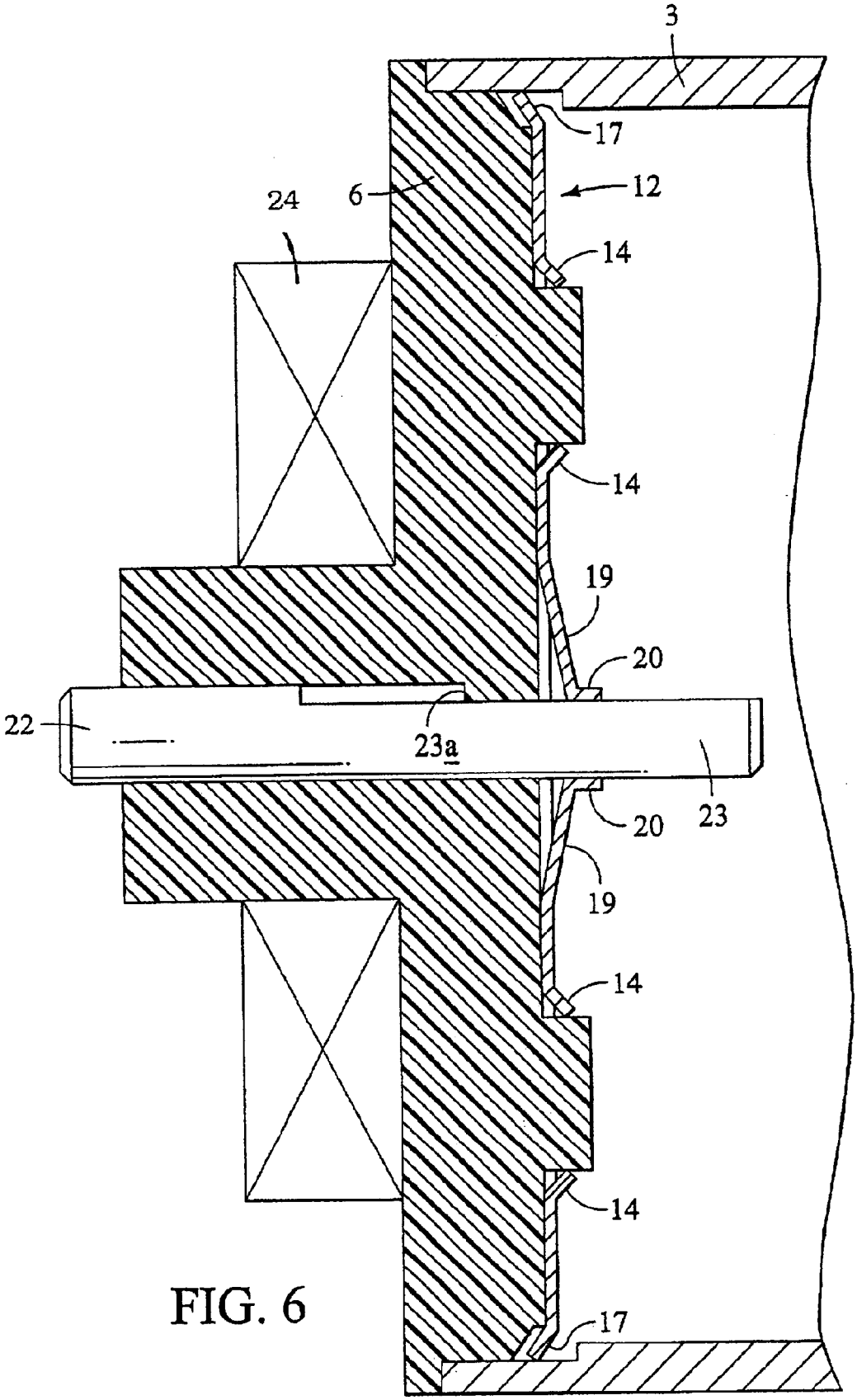
FIG. 6 is a sectional view of the drum shown in FIG. 2 and including the ground plate of FIG. 3 in position in the drum.

As shown in FIG. 6, the photosensitive drum assembly 2 further includes a ground pin 22 having a flat portion 23. The ground pin 22 is inserted through the center aperture 10 of the front end cap 6 and the central aperture 18 of the ground plate 12. The flat portion 23 of the ground pin 22 engages with a flat portion 23*a* in the center aperture 10 of the front end cap 6, preventing rotation between the ground pin 22 and the front end cap 6. The ground pin 22 extends through the central aperture 18 of the ground plate 12 so that the end portions 20 of the spring contacts 19 contact the side of the ground pin 22. The ground plate 12 may be constructed of a flexible material that is springy, such as spring steel, so that the end portions 20 of the spring contacts 19 tightly and securely contact the ground pin 22, making good electrical contact between the ground plate 12 and the ground pin 22. The ground pin 22 will be electrically connected to the printer engine frame 21 when the photosensitive drum assembly 2 is installed in the printer.

The photosensitive drum assembly 2 further includes a front support bearing 24 and a rear support bearing (not shown). The front support bearing 24 is slid onto the front end cap 6; and the rear support bearing is slid onto the rear end cap 7. The front support bearing 24 and rear support bearing provide support to the photosensitive drum assembly 2 in the image forming device 1. The photosensitive drum assembly 2 rotates on the front and rear support bearings.

The image forming device 1 further includes a front bearing support and a rear bearing support 25, and a front bearing clamp and a rear bearing clamp 26. It is noted that in FIG. 1 for simplicity of illustration, only the rear bearing support 25 and the rear bearing clamp 26 are shown. The photosensitive drum assembly 2 is installed into the image forming apparatus 1 by placing the photosensitive drum assembly 2 so that the front support bearing and rear support bearing are received by the front bearing support and the rear bearing support, respectively. The front bearing clamp and the rear bearing clamp are closed and secured around the front support bearing and the rear support bearing, respectively. The front and rear bearing clamps may include any suitable type of securing mechanism, and in the present embodiment, the front and rear bearing clamps are swung down over the bearings and fixed to the front and rear bearing supports, respectively, by screws. In this manner, the front and rear support bearings are fully encircled by the front and rear bearing supports and the clamps. The front support bearing and the rear support bearing are fully insulated by the front end cap and the rear end cap, and do not provide any grounding function for the photosensitive drum 2. The front support bearing and the rear support bearing provide a support, positioning, and rotating mechanism for locating the photosensitive drum 2 in the printer engine frame 21.

The image forming apparatus 1 further includes a spring ground contact 27 mounted on the frame 21, and a ground wire 28 connected to the engine frame 21. The spring ground contact 27 is mounted on the frame 21 adjacent to an aperture 29 in the frame. When the photosensitive drum assembly 2 is installed in the image forming apparatus 1 and secured by the front and rear bearing supports and clamps, the ground pin 22 extending from the front end cap 6 contacts the spring ground contact 27. The spring ground contact 27 tightly contacts the end of the ground pin 22, making a good electrical connection. The ground wire 28 is connected to both the spring ground contact 27 and to the engine frame 21. The ground wire 28 may be connected to the engine frame via associated wires and electrical connectors, making a reliable electrical connection. Through the ground plate 12, the ground pin 22, the spring ground contact 27, the ground wire 28, and associated wires and connectors, the photosensitive drum 3 is grounded to the frame 21.

Figure 7:
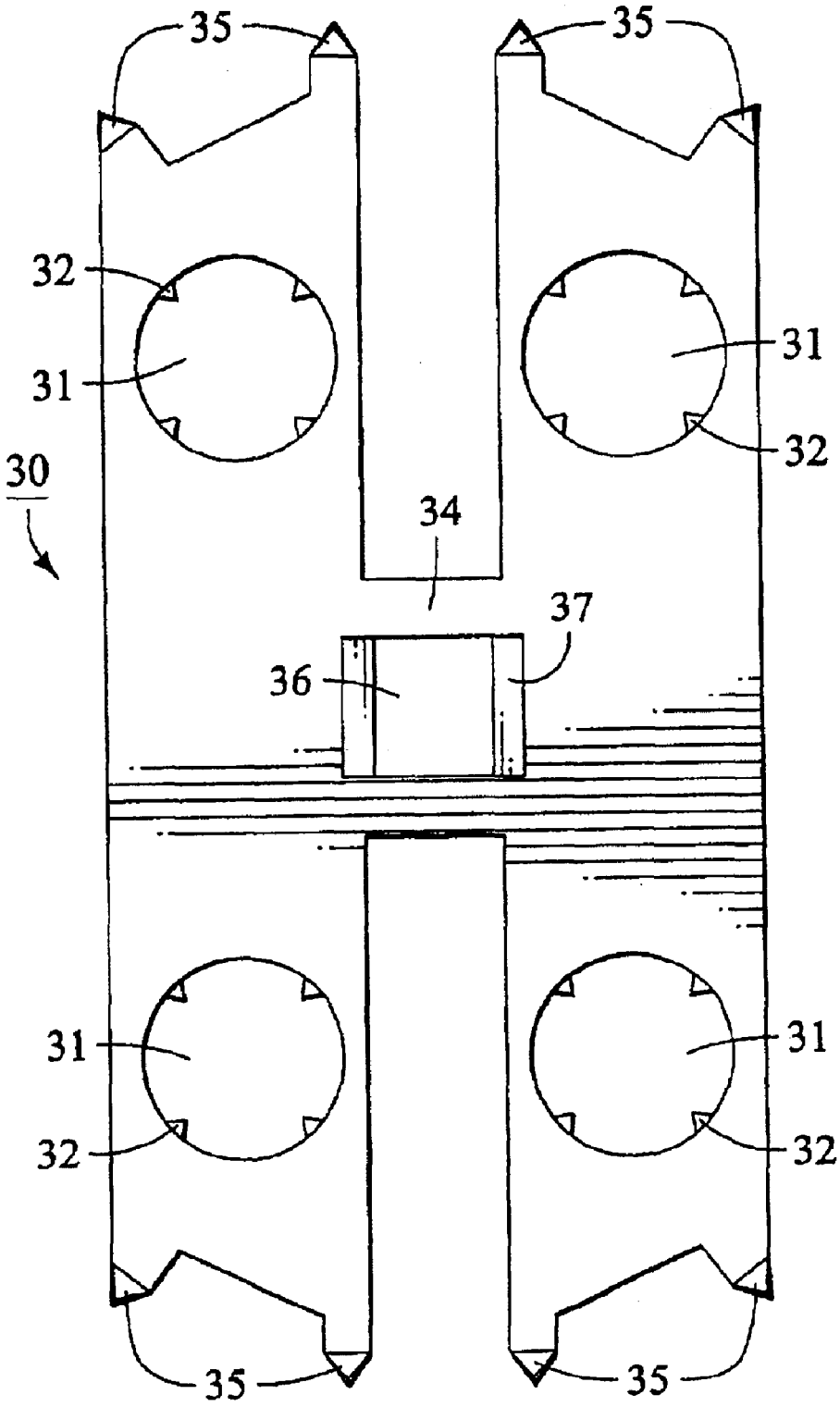
FIG. 7 is a front view of a second embodiment of the ground plate of the present invention.

With reference to FIG. 7 of the drawings, reference numeral 30 denotes a second embodiment of the ground plate. As in the first embodiment, the second embodiment of the ground plate 30 includes a plurality of apertures 31 with a plurality of tabs 32 extending toward the center of each aperture 31, a plurality of legs 33, a central portion 34, and a plurality of projections 35 extending from each leg 33. However, the second embodiment of the ground plate 30 includes a substantially rectangular central aperture 36 having a plurality of spring contacts 37 extending toward the center of the central aperture 36. In the second embodiment of the ground plate 30, the central aperture 36 and spring contacts 37 are formed without removing any material from the central portion 34 by stamping or cutting an H-shape in the central portion 34 of the ground plate 30. The stamped or cut material may be folded back to form the spring contacts 37.

Figure 8:
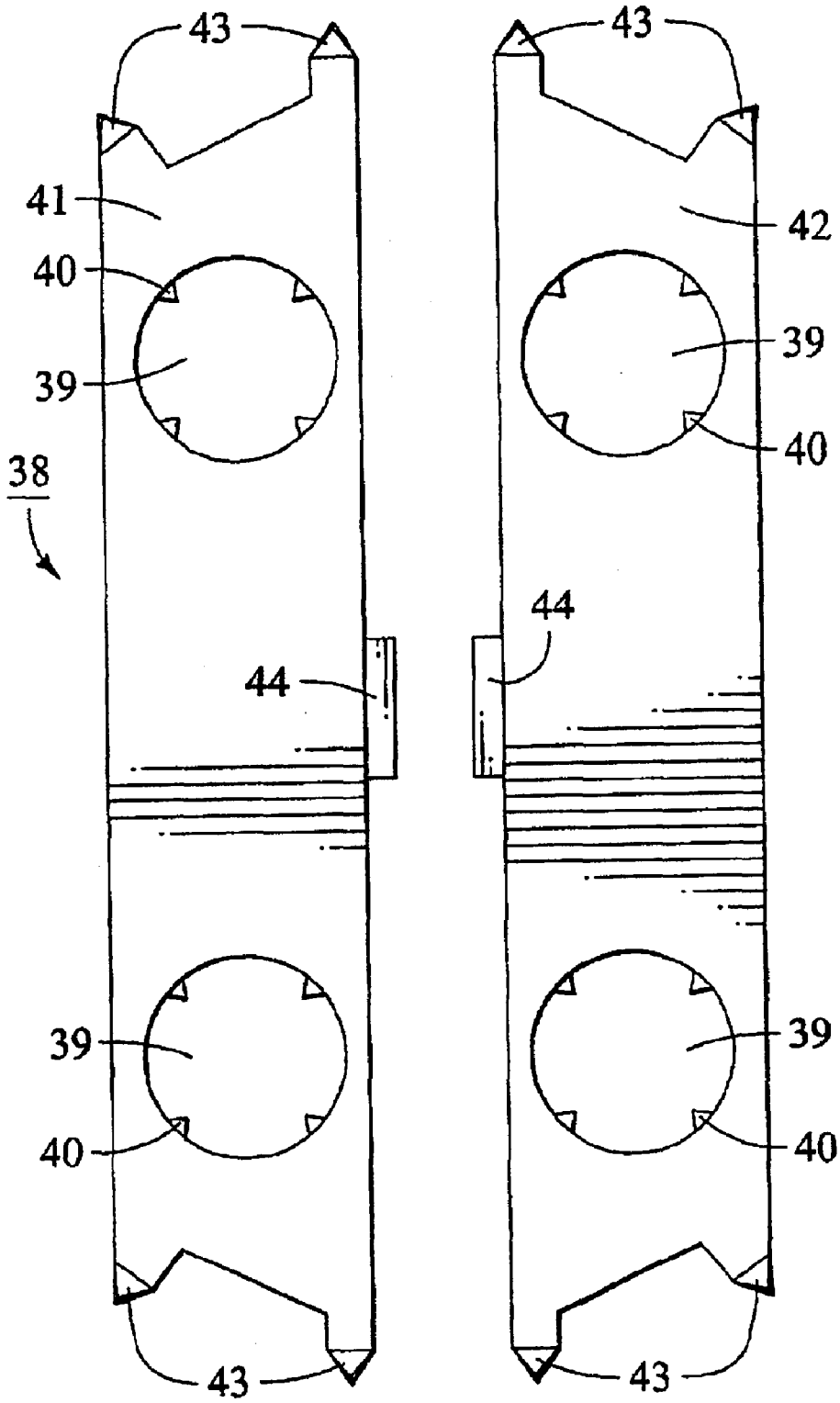
FIG. 8 is a front view of a third embodiment of the ground plate of the present invention.

With reference to FIG. 8, reference numeral 38 denotes a third embodiment of the ground plate of the present invention. As in the first embodiment, the third embodiment of the ground plate 38 includes a plurality of apertures 39 with a plurality of tabs 40 extending toward the center of each aperture 39. However, the third embodiment of the ground plate 38 includes a two piece construction including a first leg 41 and a second leg 42, and a plurality of projections 43 extending from the first leg 41 and the second leg 42. Further, in the third embodiment of the ground plate 38, each leg includes a spring contact 44 extending from a central portion thereof, so that when the ground plate 38 is fixed to an end cap, a space between the spring contacts defines an aperture and receives a ground pin.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A ground plate for a photosensitive drum assembly, comprising:

a substantially planar member, said substantially planar member including a central portion, and a plurality of legs extending from said central portion, each of said legs including a straight edge forming a portion of the outer periphery of the substantially planar member, said straight edges configured parallel to each other;

at least one projection extending from each of said plurality of legs, each of said projections being configured to scratch an inner surface of a photosensitive drum in the photosensitive drum assembly to make electrical contact between said ground plate and the photosensitive drum.

2. The ground plate for a photosensitive drum assembly according to claim 1, wherein each of said legs extend in directions substantially parallel to each other.

3. The ground plate for a photosensitive drum assembly according to claim 2, wherein each of said projections extend in directions substantially parallel to each other.

4. The ground plate for a photosensitive drum assembly according to claim 1, wherein said plurality of legs includes four legs.

5. The ground plate for a photosensitive drum assembly according to claim 4, wherein said central portion and said four legs substantially form an H shape.

6. The ground plate for a photosensitive drum assembly according to claim 1, wherein each of said legs includes two projections extending therefrom to scratch the inner surface of the photosensitive drum.

7. The ground plate for a photosensitive drum assembly according to claim 1, wherein said projections extend out of the plane of the substantially planar member.

8. The ground plate for a photosensitive drum assembly according to claim 1, wherein said substantially planar member includes a two piece construction.

9. The ground plate for a photosensitive drum assembly according to claim 8, wherein said substantially planar member includes a first leg and a second leg, each of said first leg and said second leg including a spring contact extending from a central portion thereof, said first and second legs being spaced from each other to secure a ground pin therebetween when fixed to an end cap.

10. The ground plate for a photosensitive drum assembly according to claim 9, wherein said ground plate includes two spring contacts.

11. The ground plate for a photosensitive drum assembly according to claim 1, said ground plate further including:

a central aperture in said central portion; and a plurality of spring contacts extending from an edge of said central aperture and into said central aperture;

wherein said central aperture receives a ground pin therethrough and said plurality of spring contacts engage the ground pin to make electrical contact between said ground plate and the ground pin.

12. The ground plate for a photosensitive drum assembly according to claim 1, wherein said ground plate further includes:

a plurality of apertures provided in said substantially planar member, each of said apertures being configured to receive a protrusion on an end cap of the photosensitive drum assembly, and a plurality of projections provided in each of said apertures, said projections being configured to engage the protrusions on the end cap of the photosensitive drum received in said apertures and to fix said ground plate to the end cap of the photosensitive drum.

13. A photosensitive drum assembly for an image forming device, said photosensitive drum assembly comprising:

a photosensitive drum, said drum including a photosensitive layer on an outer surface thereof, a first end cap and a second end cap, said end caps being configured to fit into the ends of said drum; and a ground plate fixed to an inner face of said first end cap, said ground plate including a substantially planar member, said substantially planar member including a central portion, and a plurality of legs extending from said central portion, each of said legs including a straight edge forming a portion of the outer periphery of the substantially planar member, said straight edges configured parallel to each other; at least one projection extending from each of said plurality of legs, each of said projections being configured to scratch an inner surface of said photosensitive drum to make electrical contact between said ground plate and said photosensitive drum.

14. The photosensitive drum assembly for an image forming device according to claim 13, said photosensitive drum assembly further including:

a ground pin extending through an aperture in said first end cap; and said ground plate further including a central aperture in said central portion, and a plurality of spring contacts extending into said central aperture, wherein said central aperture receives said ground pin therethrough and said plurality of spring contacts engage said ground pin to make electrical contact between said ground plate and said ground pin.

15. An image forming device comprising:

a printer engine; and a photosensitive drum assembly mounted in said printer engine, said photosensitive drum assembly including:

a photosensitive drum including a photosensitive layer on an outer surface thereof;

a first end cap and a second end cap, said end caps being configured to fit into the ends of said drum; and a ground plate fixed to an inner face of said first end cap, said ground plate including a substantially planar member, said substantially planar member including a central portion, and a plurality of legs extending from said central portion, each of said legs including a straight edge forming a portion of the outer periphery of the substantially planar member, said straight edges configured parallel to each other; at least one projection extending from each of said plurality of legs, each of said projections being configured to scratch an inner surface of said photosensitive drum to make electrical contact between said ground plate and said photosensitive drum.

16. The image forming device according to claim 15, said image forming device further including:

an engine frame;

a spring ground contact mounted on said engine frame;

said photosensitive drum assembly further including:

a ground pin extending through an aperture in said first end cap; and said ground plate further including a central aperture in said central portion, and a plurality of spring contacts extending into said central aperture, wherein said central aperture receives said ground pin therethrough and said plurality of spring contacts engage said ground pin to make electrical contact between said ground plate and said ground pin, and wherein said ground pin is configured to contact said spring ground contact to make electrical contact between said ground pin and said spring ground contact to ground said photosensitive drum.

17. A ground plate for a photosensitive drum assembly, comprising:

a substantially planar member, said substantially planar member including a central portion, and a plurality of legs extending from said central portion, at least one projection extending from each of said plurality of legs, each of said projections being configured to scratch an inner surface of a photosensitive drum in the photosensitive drum assembly to make electrical contact between said ground plate and the photosensitive drum;

wherein said substantially planar member includes a two piece construction.

18. The ground plate for a photosensitive drum assembly according to claim 17, wherein said substantially planar member includes a first leg and a second leg, each of said first leg and said second leg including a spring contact extending from a central portion thereof, said first and second legs being spaced from each other to secure a ground pin therebetween when fixed to and end cap.

19. The ground plate for a photosensitive drum assembly according to claim 18, wherein said ground plate includes two spring contacts.

* * * * *